US010103500B2

(12) United States Patent
Zebhauser et al.

(10) Patent No.: US 10,103,500 B2
(45) Date of Patent: Oct. 16, 2018

(54) PLUG CONNECTOR ARRANGEMENT WITH SLEEVE PART

(71) Applicant: ROSENBERGER HOCHFREQUENZTECHNIK GMBH & CO. KG, Fridolfing (DE)

(72) Inventors: Martin Zebhauser, Laufen (DE); Gunnar Armbrecht, Mühldorf am Inn (DE); Stephan Kunz, Chieming (DE)

(73) Assignee: Rosenbergerhochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/547,104

(22) PCT Filed: Jan. 21, 2016

(86) PCT No.: PCT/EP2016/000106
§ 371 (c)(1),
(2) Date: Jul. 28, 2017

(87) PCT Pub. No.: WO2016/120006
PCT Pub. Date: Aug. 4, 2016

(65) Prior Publication Data

US 2018/0026402 A1 Jan. 25, 2018

(30) Foreign Application Priority Data

Jan. 30, 2015 (DE) ..... 20 2015 000 753 U

(51) Int. Cl.
*H01R 9/03* (2006.01)
*H01R 13/6581* (2011.01)
(Continued)

(52) U.S. Cl.
CPC ..... *H01R 13/6581* (2013.01); *H01R 4/20* (2013.01); *H01R 13/6463* (2013.01)

(58) Field of Classification Search
CPC ..... H01R 13/6581; H01R 13/3812; H01R 13/6463; H01R 9/034; H01R 4/20
(Continued)

(56) References Cited

U.S. PATENT DOCUMENTS 6,875,046 B2 * 4/2005 Chiu ..... H01R 13/5812 439/460
7,175,468 B1 2/2007 Chang
(Continued)

FOREIGN PATENT DOCUMENTS

DE 4318800 A1 12/1994
EP 0238316 A2 9/1987
(Continued)

*Primary Examiner* — Jean F Duverne
(74) *Attorney, Agent, or Firm* — DeLio, Peterson & Curcio, LLC; Robert Curcio

(57) ABSTRACT

A plug connector arrangement having a plug connector and a cable connected thereto, with at least one conductor pair for transmitting a differential signal, wherein the conductors of the conductor pair have a first mutual spacing (X) in a sheathed cable section, diverge in an expansion section in the direction of the plug connector, and have a larger second mutual spacing (Y) in a guide section of the plug connector, wherein a sleeve part at least partially surrounding the conductor pair in the expansion section is provided to exert pressure on the conductors of the conductor pair at least in sections, in order to reduce the spacing therebetween.

21 Claims, 2 Drawing Sheets

(51) Int. Cl.
*H01R 4/20* (2006.01)
*H01R 13/6463* (2011.01)

(58) Field of Classification Search
USPC ..... 439/607.5
See application file for complete search history.

(56) References Cited

U.S. PATENT DOCUMENTS

| | | | | |
|---|---|---|---|---|
| 8,033,863 | B2 * | 10/2011 | Gutter ..... | H01R 9/034<br>439/620.07 |
| 2006/0035514 | A1 | 2/2006 | Yohn | |
| 2007/0259568 | A1 | 11/2007 | Mackillop | |
| 2014/0273619 | A1 | 9/2014 | Showcatally et al. | |

FOREIGN PATENT DOCUMENTS

| | | | |
|---|---|---|---|
| EP | 2768086 | A1 | 8/2014 |
| GB | 830192 | A1 | 3/1960 |
| WO | 1993003527 | A1 | 2/1993 |

* cited by examiner

PLUG CONNECTOR ARRANGEMENT WITH SLEEVE PART

BACKGROUND OF THE INVENTION

1. Field of the Invention

The invention relates to a plug connector arrangement comprising a plug connector and a cable connected thereto. At least one wire pair for transmitting a differential signal runs within the cable, wherein the wires of the wire pair are spaced at a first mutual distance within the interior of the cable. This first mutual distance can be achieved in that the wire pair is sheathed by means of an outer cable layer, for example an outer conductor (for example a conductor braid or a foil shield), an insulator and/or a protective sheath or similar which lies against the wire pair on the outside and holds the wire pair, spaced apart at the first distance, within the interior of the cable. The mutual distance between the wires is thereby measured perpendicular to the longitudinal direction of the cable between the centers of the two wires. Starting out from the sheathed cable section, the two wires of the wire pair diverge in the direction of the plug connector in an expansion section until they enter a guide section of the plug connector in which they are spaced apart at a second mutual distance which is greater than the first mutual distance.

The plug connector has a plug-side end for connecting the plug connector with a mating plug connector and a cable-side end to which the cable is fixed, for example through soldering and/or crimping. The wires of the wire pair can be connected electrically within the plug connector with inner conductor contact elements of the plug connector.

The cable is for example a twisted-pair cable comprising one or more wire pairs which are twisted together in pairs which are in each case intended for the transmission of a differential signal, for example a data signal, telecommunication signal, RF signal or similar. The twisting can provide improved protection against external fields. Alternatively, the cable has more than two differential wire pairs and is for example a star quad cable or similar.

2. Description of Related Art

A conventional plug connector arrangement 200 comprising a cable 220 with a wire pair 222 which is connected to a plug connector 210 is illustrated in FIG. 1. As is clearly shown in the figure, the wires of the wire pair 222 are spaced apart at a first mutual distance X in the interior of the cable 232 and at a second mutual distance Y in the interior of an insulator part 216 of the plug connector 210. In between, the two wires of the wire pair 222 diverge in an expansion section 234.

However, it has been found that differential data signals cannot be transmitted optimally in particular frequency ranges via such a conventional plug connector arrangement. Instead, reflections and other forms of signal interference can occur which affect the signal transmission. In view of the described problems, it is the object of the present invention to improve the signal transmission at a transition between a cable and a plug connector, in particular in the high frequency range, and to minimize interference.

SUMMARY OF THE INVENTION

This problem is solved through a plug connector arrangement according to the independent claims. Advantageous further developments of the invention are described in the dependent claims.

The above and other objects, which will be apparent to those skilled in the art, are achieved in the present invention which is directed to a plug connector arrangement comprising a plug connector and a cable connected thereto with at least one wire pair for transmission of a differential signal, wherein the wires of the wire pair are spaced apart at a first mutual distance (X) in a sheathed cable section, diverge, in an expansion section, in the direction of the plug connector, and in a guide section of the plug connector are spaced apart at a greater second mutual distance (Y), wherein a sleeve part, at least partially surrounding the wire pair in the expansion section, exerts pressure on the wires of the wire pair, at least in sections, in order to reduce the distance therebetween, wherein the sleeve part (40) is radially deformed through the external application of pressure, in particular by being pressed or crimped, in order to further reduce the distance between the wires of the wire pair running through the sleeve part.

The sleeve part is a sleeve completely surrounding the wire pair or a clamping part at least partially surrounding the wire pair. Furthermore, the sleeve part has an inner surface which is angled, conical or convex, relative to the longitudinal direction of the cable (L), wherein preferably an inner diameter of the sleeve part is matched at its cable-side end to the first distance (X) and is matched at its plug connector-side end to the second distance (Y).

Additionally, the sleeve part is arranged and formed such that, after emerging from the sheathed cable section, the wires continue to run spaced at substantially the first mutual distance (X) and then diverge in the expansion section with increased curvature in the direction of the guide section.

The plug connector arrangement may include a spacer projecting into the expansion section which is arranged between the wires of the wire pair and against which the wires are pressed by the sleeve part. The sleeve part and/or the spacer may also be formed of a non-conductive material.

The cable has an outer conductor surrounding the wire pair and the plug connector has an outer conductor part, which is connected electrically with the outer conductor. The outer conductor may be pressed or crimped together with the outer conductor part.

The sleeve part, at least at its cable-side end, has approximately the same inner diameter as the outer conductor of the cable and continues a shielding of the wire pair in the direction of the plug connector.

The plug connector includes an insulator part with guide channels for the wires of the wire pair which are spaced apart transversely to the longitudinal direction of the cable, wherein the guide channels form the guide section.

The wires of the wire pair are in each case connected at their plug connector-side ends, with inner conductor contact elements of the plug connector.

In the guide section of the plug connector the wires are in each case surrounded by a wire sleeve made of an electrically conductive material adjoining the expansion section in order to reduce the distance between the wires.

The end of each wire sleeve facing the expansion section surrounds the wire insulation and/or the other end of each wire sleeve surrounds and makes electrical contact with a non-insulated wire conductor, wherein preferably both ends of the wire sleeves are in each case crimped onto the wire.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
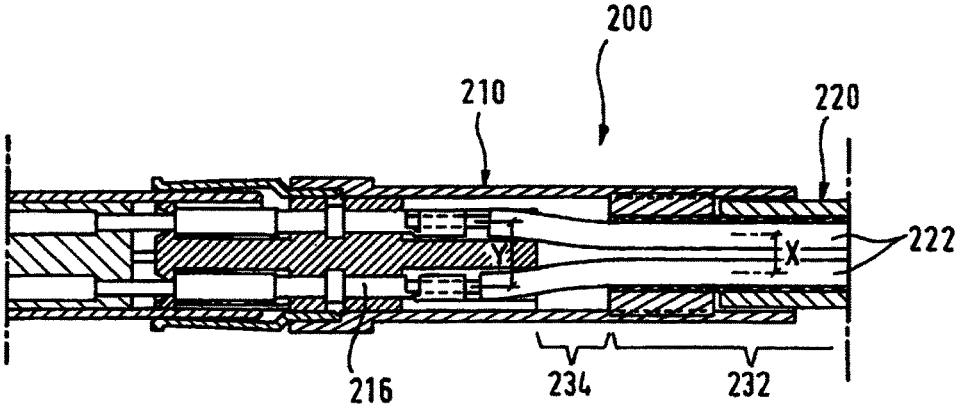
Fig. 1 (Prior Art)
FIG. 1 shows a conventional plug connector arrangement in longitudinal section.

In describing the preferred embodiment of the present invention, reference will be made herein to FIGS. 1-4 of the drawings in which like numerals refer to like features of the invention.

A plug connector arrangement according to the invention has a sleeve part, at least partially surrounding the wire pair in the expansion section, which is designed to exert pressure on the wires of the wire pair, at least in sections, in order to reduce the distance between same.

The invention is based on the knowledge that the characteristic impedance or the impedance, both in the interior of the cable and also in the interior of the plug connector, is set to a specified and preferably standardized value through the geometry or the mutual arrangement of the wires of the wire pair in combination with the dielectric arranged between these, whereas abrupt changes in the characteristic impedance can occur at the point of transition between the cable and the plug connector as a result of the changing distance between the wires and the changing dielectric at this point. Such abrupt changes, for example jumps, fluctuations and other irregularities, can lead to the interference described above, for example signal reflections. It is therefore advantageous to shorten the region, in the longitudinal direction of the cable, in which the distance between the wires changes, and to configure the geometry of the wire pair in this region such that an abrupt change in the characteristic impedance is reduced or avoided. This is achieved according to the invention in that the two wires are pressed together in the expansion section through a sleeve part surrounding the wire pair in order to reduce the distance between them. In other words, a pressure is exerted on the wire pair radially from the outside through the sleeve part, so that the first distance between the wires is also continued, in the direction of the guide section of the plug connector, where the wire pair is no longer sheathed by an outer layer of the cable.

The plug connector arrangement according to the invention can be shielded or unshielded. In a shielded plug connector arrangement, on the one hand the cable has an outer conductor surrounding the wire pair, for example a conductor braid, and on the other hand the plug connector has an outer conductor part surrounding inner conductor contacts, for example an outer conductor housing. In this case the wire pair is preferably also surrounded by a shielding, for example a metallic sleeve section of the plug connector, in the expansion section. In the case of an unshielded plug connector arrangement, the cable and/or the plug connector do not have any outer conductor or outer conductor part.

According to a first embodiment of the invention, the sleeve part is a sleeve completely surrounding the wire pair, for example a closed sleeve in the form of a cylinder barrel. During assembly of the plug connector arrangement, such a sleeve can be pushed, starting out from the cable, in the direction of the guide section, until it presses together the wires diverging in the expansion section, at least in sections, and is held there in a form-locking and/or force-locking manner. Alternatively, the sleeve part is a clamping part at least partially surrounding the wire pair, for example a clamping sleeve, a clip sleeve, a C-sleeve or similar. A clamping part can also be clipped onto the wire pair from the side, after attaching the cable to the plug connector, in the expansion section, where it is held in a form-locking and/or force-locking manner and presses together the wire pair. Such a clamping part can surround the wire pair completely or only partially. The sleeve part can also consist of two or more sleeve sections connected together which are placed on the wire pair from different sides.

In order to achieve an optimal guidance of the wire pair through the sleeve part up to the guide section of the plug connector, it has proved expedient if the sleeve part has an inner surface which is angled, in particular conical or convex, relative to the longitudinal direction of the cable. This means that the wire pair can be guided apart exactly with a defined curvature and/or in a desired curve, which has proved expedient in order to achieve as constant as possible a curve of the characteristic impedance.

Preferably, the inner diameter of the sleeve part is matched approximately to the first distance at its cable-side end and is matched approximately to the second distance at its plug connector-side end. For example, the sleeve part has approximately the same inner diameter at its cable-side end as a wire pair sheathing in the sheathed cable section. This inner diameter can correspond to the first distance plus one times the wire diameter. The inner diameter of the sleeve part at its plug connector-side end can correspond to the second distance plus one times the wire diameter.

In other words, the sleeve part is preferably arranged and formed such that, after emerging from the sheathed cable section, the wires preferably continue to run parallel, spaced at substantially the first mutual distance, and then diverge in the expansion section with more pronounced curvature in the direction of the guide section, until they enter the guide section of the plug connector, again running substantially parallel, spaced apart at an enlarged distance.

In a particularly preferred embodiment of the invention, the sleeve part is deformed radially through the external application of pressure, in particular by being pressed against the wire pair, for example pressed or crimped, in order to further reduce the distance between the wires of the wire pair running through the sleeve part.

In order to avoid damage to the wire pair during a deformation of the sleeve part through the radial application of pressure, it has proved expedient to provide a preferably non-conductive spacer, for example a mandrel, which starting out from the plug connector projects into the expansion section and which is arranged between the wires of the wire pair and against which the wires are pressed by the sleeve part. Excessive deformation of the sleeve part and thus too forceful a compression of the wires can be prevented by means of the mandrel. Moreover, the material of the mandrel can be selected such that a specified curve of the characteristic impedance is achieved in the expansion section. For this purpose, the mandrel can consist of a non-conductive material, for example a plastics material or another dielectric or insulator material. A mandrel made of a non-conductive material has the further advantage that the two wires cannot come into electrical contact on being pressed together, even if the wire insulation is, in sections, missing in the expansion section.

The sleeve part can also be formed of a non-conductive material, for example a plastics material. The material of the sleeve part can be selected such that a specified curve of the characteristic impedance in the expansion section is achieved.

In a particularly preferred embodiment of the invention, the cable has an outer conductor surrounding the wire pair, for example a conductor braid or foil shield, which provides a shielding of the at least one wire pair. In order to achieve a continuous shielding as far as the plug-side end of the plug connector, it has proved expedient for the plug connector to also have an outer conductor part, for example in the form of an outer conductor housing, made of a conductive material, which is connected electrically with the outer conductor. In order also to create a shielding in the transitional region between the cable and the plug connector, the outer conductor part can have a sleeve section projecting in the direction of the cable which surrounds the wire pair and the sleeve part in the expansion section and lies against the outside of the outer conductor of the cable.

The outer conductor of the cable, preferably in the form of a conductor braid, is preferably directly or indirectly pressed or crimped together with the outer conductor part of the plug connector. For this purpose, the conductor braid can be folded back over a crimp sleeve attached at the front end of the sheathed cable section. The crimp sleeve, or the outer conductor folded over same, preferably forms the plug connector-side end of the sheathed cable section.

In order also to achieve an optimal electrical matching of the shielded plug connector arrangement in the transitional region between the cable and the plug connector, it has proved advantageous if the sleeve part, at least at its cable-side end, has approximately the same inner diameter as the outer conductor of the cable, so that a shielding of the wire pair is continued in the direction of the plug connector. In this case the sleeve part is formed of an electrically conductive material, for example of metal. This aspect of the invention is based on the knowledge that in order to achieve an as far as possible constant characteristic impedance in the longitudinal direction of the cable, a substantially constant distance between the wire pair and the outer conductor is advantageous, since an increase or abrupt change in the distance between the inner conductor and outer conductor generally leads to an inductive region or to an undesired rise in impedance. According to the invention, as a result of the sleeve part the shielding is continued, starting out from the front axial end of the outer conductor, at an approximately constant distance from the wire pair, so that no abrupt change in impedance occurs in this region.

A stable structure of the plug connector with a defined mutual distance between the wire sections running therein and inner conductor contact elements is made possible in that the plug connector has an insulator part with guide channels for the wires of the wire pair which are spaced apart transversely to the longitudinal direction of the cable, through which the guide section is formed. In the guide channels, the wires of the wire pair can in each case be connected, in particular crimped together with the inner conductor contact elements of the plug connector at their plug connector-side ends.

It has been found that, despite the sleeve part pressing together the wires in the expansion section, the mutual distance between the wires is, at least in sections, generally still too great, so that an optimal electrical matching at the transition between the expansion section and the guide section of the plug connector is not yet achieved. The distance between the two wires at this transition can be further reduced in that the front ends of the wires projecting into the guide section are, at least in sections, in each case surrounded by a wire sleeve made of an electrically conductive material adjoining the expansion section. The wire sleeves are in each case in electrical contact with the conductor of the associated wire and preferably surround the wire completely. As a result of the wire sleeves, which in each case increase the wire diameter, the distance between the two wires or between the two wire conductors is reduced, as a result of which variations in the characteristic impedance can be further reduced in this region. The wire sleeves can be crimped onto the wire conductor and/or onto the wire insulation (ISO crimp). Crimping onto the wire insulation leads to a particularly pronounced reduction in the distance between the two wire conductors. Alternatively or additionally, the wires can be connected with the inner conductor contact elements of the plug connector by means of the wire sleeves. Furthermore, the distance between the individual wires and a common outer conductor part surrounding the wires can also be reduced through the wire sleeves, as a result of which the curve of the characteristic impedance over the expansion section can be further improved.

In a particularly preferred embodiment of the invention, the end of each wire sleeve facing the expansion section surrounds the wire insulation, and the other end of each wire sleeve surrounds the wire conductor directly, makes electrical contact with same and connects it with the inner conductor contact element of the plug connector. The end of the wire sleeve facing the expansion section is thereby preferably crimped onto the outside of the wire insulation (ISO crimp), and the plug connector-side end of the wire sleeve is crimped onto the wire conductor. This leads to a particularly high-tensile connection between the wire pair and the inner conductor contact elements of the plug connector providing optimal electrical matching.

In the following description, the invention is explained with reference to the attached drawings, which show details which are important to the invention and which are not described in detail in the description.

Figure 2:
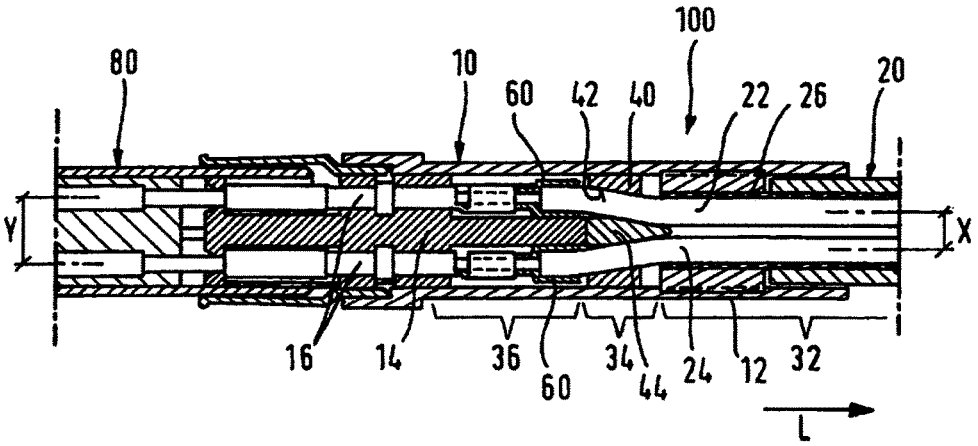
FIG. 2 shows a plug connector arrangement according to the invention in longitudinal section.

In FIGS. 1 and 2, a conventional plug connector arrangement (FIG. 1) and a plug connector arrangement according to the invention (FIG. 2) are compared. The plug connector arrangement 100 according to the invention shown in FIG. 2 consists of a plug connector 10 and a cable 20 attached thereto with high tensile strength, for example a shielded twisted-pair cable or a star quad cable with two differential wire pairs.

The cable 20 is attached at the cable-side end of the plug connector 10, while a mating plug connector 80 is plugged detachably into the plug-side end of the plug connector 10.

In the illustrated embodiment, the cable 20 is a shielded twisted-pair cable with a twisted wire pair 22, 24 and an outer conductor 26 surrounding the wire pair 22, 24 which can be in the form of a conductor braid. Within the interior of the cable, the two wires 22, 24 run in the longitudinal direction of the cable L spaced apart at a specified distance X. Such a cable is particularly suitable for the transmission of a differential signal, for example an RF signal, a data signal, telecommunication signal etc. A specified impedance curve over the entire extension of the plug connector arrangement in the longitudinal direction of the cable L is important in order to avoid interference, for example reflections. In particular, significant variations or fluctuations in the characteristic impedance, abrupt changes in impedance etc. are undesirable.

The cable can also comprise more than one wire pair. For example, the cable can have two or more wire pairs stranded together, possibly in a star quad arrangement, which can be surrounded by a common outer conductor for the purpose of shielding.

After emerging from a sheathed cable section 32, the two wires 22, 24 diverge in an expansion section 34 until they enter a guide section 36 of the plug connector 10. In the guide section 36, the wires 22, 24 are in each case arranged in a guide channel of an insulator part 14, by means of which a specified greater second distance Y between the two wires 22, 24 is ensured. In the guide section 36, the wires 22, 24 are in each case connected electrically with inner conductor contact elements 16 of the plug connector 10. The inner conductor contact elements 16 of the plug connector are designed to make electrical contact with mating inner conductor contact elements of the mating plug connector 80.

In the expansion section 34, in which the wires 22, 24 of the wire pair diverge, the wire pair is at least partially surrounded by a sleeve part 40, which exerts pressure on the wires from the outside and in this way reduces the distance between them. The sleeve part 40 can have a cylindrical outer surface and a substantially conical inner surface 42, wherein the conical inner surface lies in close contact with the wires 22, 24 and presses these together. For this purpose, the sleeve part 40 can be deformed through the application of pressure from the outside. Alternatively or additionally, the sleeve part is clamped onto the wire pair. In the expansion section 34, a spacer 44 narrowing in the direction of the sheathed cable section 32, for example a mandrel, is provided between the two wires 22, 24, against which the two wires 22, 24 are pressed from outside. The outer surface of the spacer or mandrel 44 can be adapted, in terms of its curvature in the longitudinal direction of the cable L, to the inner surface 42 of the sleeve part 40, so that free spaces accommodating the wires 22, 24 are formed between these. The mandrel 44 preferably consists of a non-conductive material, for example a dielectric material. This has proved particularly expedient, on the one hand in order to achieve a desired impedance curve and on the other hand in order to prevent an electrical contact between the two wires 22, 24. The mandrel 44 can be connected integrally with the plug connector 10. For example, the mandrel 44 is fixed to the insulator part 14 and projects from there into the expansion section 34.

The inner diameter of the plug connector-side end of the sleeve part 40 is, approximately, larger than the inner diameter of the cable-side end of the sleeve part 40 by the difference between the second distance Y and the first distance X. As a result, the distance between the wires X in the interior of the cable is, through the sleeve part 40, continued further in the direction of the plug connector. Only along the inner surface 42 of the sleeve part curving obliquely outwards do the wires 22, 24 curve outwards with more pronounced curvature until they enter the guide section 36.

In a first embodiment according to the invention, the sleeve part consists of a non-conductive material, for example plastic. In an alternative embodiment according to the invention, the sleeve part consists of a conductive material, for example metal. In this case, the sleeve part 40 can continue the shielding of the wire pair following the plug connector-side end of the outer conductor 26 of the cable 20. For example, the sleeve part 40 directly adjoins the plug connector-side end of the outer conductor 26.

The wires 22, 24 of the wire pair in each case have a wire sleeve 60 which is arranged in the guide section 36 adjacent to the expansion section 34 and surrounds the relevant wire. The wire sleeve 60 is in each case connected electrically with the associated wire conductor. As a result, the distance between the two wire conductors at the transition between the expansion section 34 and the guide section 36 is further reduced.

Preferably, the wire sleeve is crimped onto the wire insulation (ISO crimp) and/or onto the wire conductor. In the particularly preferred embodiment shown in FIG. 2, the cable-side end of the wire sleeve 60 is in each case crimped onto the wire insulation in order to reduce the distance between the wire conductors, and the other end of the wire sleeve 60 is crimped directly onto the wire conductor in order to connect this in a high-tensile manner with the inner conductor contact element 16.

Figure 3:
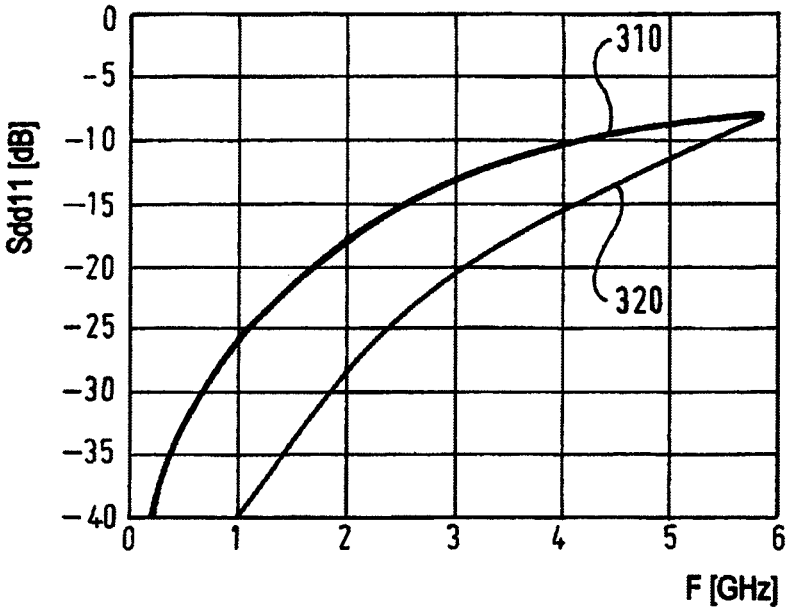
FIG. 3 shows return losses of RF signals in relation to the signal frequency, wherein the RF signals are passed through the plug connector arrangement.

FIG. 3 shows reflection losses ("return loss") of signals in relation to the signal frequency. Reference number 310 identifies signals which are passed through the conventional plug connector arrangement shown in FIG. 1, and reference number 320 identifies signals which are passed through the plug connector arrangement according to the invention shown in FIG. 2. It can clearly be seen that in the frequency range up to approximately 6 GHz, in particular between 1.5 GHz and 6 GHz, significantly lower losses occur when using the plug connector arrangement according to the invention.

The significant improvements are attributable to the fact that in the plug connector arrangement according to the invention which, in contrast to the conventional plug connector arrangement, has a sleeve part 40 and wire sleeves 60 with ISO crimp, the impedance curve in the longitudinal direction of the cable L exhibits lower fluctuations.

Figure 4:
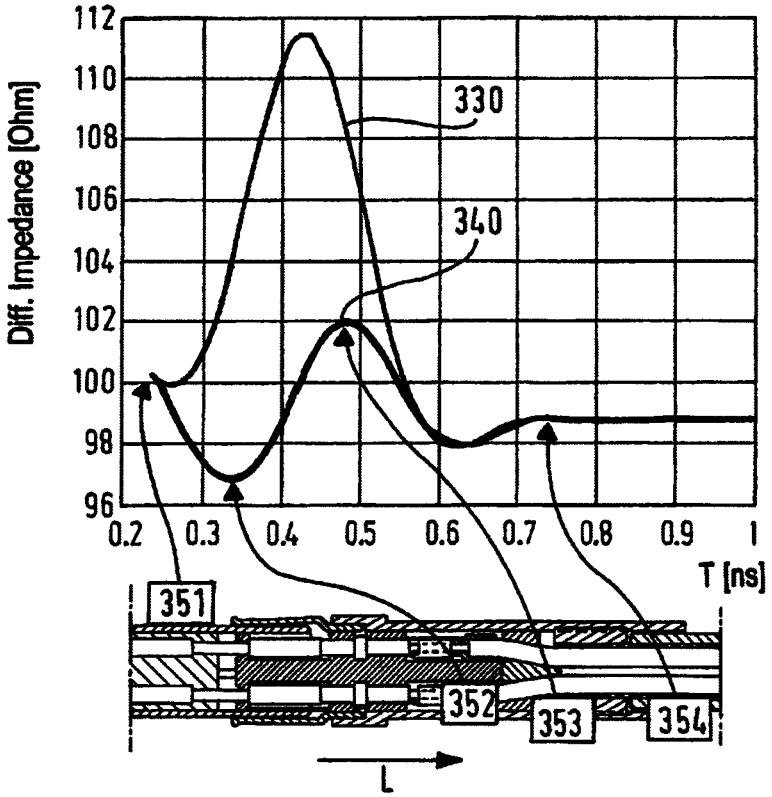
FIG. 4 shows the characteristic impedance of the plug connector arrangement in relation to the signal runtime or in relation to the position in the direction of the cable L.

This can be seen particularly clearly in FIG. 4, which shows the characteristic impedance in relation to the signal runtime or in relation to the position in the longitudinal direction of the cable L. Reference number 330 identifies the conventional plug connector arrangement without sleeve part 40 and wire sleeves 60 shown in FIG. 1, and reference number 340 identifies the plug connector arrangement according to the invention shown in FIG. 2.

The impedance at the plug-side end of the plug connector is in each case approximately 100 ohms (see reference number 351) and the impedance in the interior of the cable is in each case approximately 99 ohms (see reference number 354). In between, the impedance in the conventional plug connector arrangement 200 passes through a distinct maximum, which lies approximately in the region of the expansion section 234 (see reference number 330). This maximum leads to signal interference and reflections, as can be seen from FIG. 3.

In contrast, the impedance of the plug connector arrangement 100 according to the invention exhibits significantly reduced fluctuations (see reference number 340). The region of the ISO crimp is now somewhat too capacitive (see reference number 352) and the transition between the sheathed cable section 32 and the expansion section 34 is still somewhat too inductive (see reference number 353), albeit much improved. These two effects therefore compensate each other very well for frequencies up to approximately 6 GHz; this functions less well for even higher frequencies.

A further improvement can be achieved through thinner-walled wire sleeves 60 and/or a smaller wire diameter in the region of the ISO crimp. The wires in the expansion section 34 can also be pressed even further together. Also, additionally or alternatively, a star crimp might be considered in order to apply even greater pressure on the wire pair.

The invention is not limited to the described embodiment. For example, the cable can comprise more than one wire pair. Also, the cable is not necessarily shielded and does not necessarily have an outer conductor. The sleeve part can be a separate component or alternatively can be connected with the plug connector or integrated therein. The sleeve part can be connected with the wire pair in a form-locking, force-locking and/or adhesively bonded manner.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector arrangement comprising a plug connector and a cable connected thereto with at least one wire pair for transmission of a differential signal, wherein the wires of the wire pair are spaced apart at a first mutual distance (X) in a sheathed cable section, diverge, in an expansion section, in the direction of the plug connector, and in a guide section of the plug connector are spaced apart at a greater second mutual distance (Y), wherein a sleeve part, at least partially surrounding the wire pair in the expansion section, exerts pressure on the wires of the wire pair in the expansion section, in order to reduce the distance therebetween, wherein the sleeve part is radially deformed through the external application of pressure, in particular by being pressed or crimped, in order to further reduce the distance between the wires of the wire pair running through the sleeve part.

2. The plug connector arrangement of claim 1, wherein the sleeve part is a sleeve completely surrounding the wire pair or a clamping part at least partially surrounding the wire pair.

3. The plug connector arrangement of claim 1, wherein the sleeve part has an inner surface which is angled, conical or convex, relative to the longitudinal direction of the cable (L), wherein preferably an inner diameter of the sleeve part is matched at its cable-side end to the first distance (X) and is matched at its plug connector-side end to the second distance (Y).

4. The plug connector arrangement of claim 1, wherein the sleeve part is arranged and formed such that, after emerging from the sheathed cable section, the wires continue to run spaced at substantially the first mutual distance (X) and then diverge in the expansion section with increased curvature in the direction of the guide section.

5. The plug connector arrangement of claim 1, including a spacer projecting into the expansion section which is arranged between the wires of the wire pair and against which the wires are pressed by the sleeve part.

6. The plug connector arrangement of claim 1, wherein the sleeve part and/or the spacer is formed of a non-conductive material.

7. The plug connector arrangement of claim 1, wherein the cable has an outer conductor surrounding the wire pair and the plug connector has an outer conductor part, which is connected electrically with the outer conductor.

8. The plug connector arrangement of claim 7, wherein the outer conductor is pressed or crimped together with the outer conductor part.

9. The plug connector arrangement of claim 7, wherein the sleeve part, at least at its cable-side end, has approximately the same inner diameter as the outer conductor of the cable and continues a shielding of the wire pair in the direction of the plug connector.

10. The plug connector arrangement of claim 1, wherein the plug connector includes an insulator part with guide channels for the wires of the wire pair which are spaced apart transversely to the longitudinal direction of the cable, wherein the guide channels form the guide section.

11. The plug connector arrangement of claim 1, wherein the wires of the wire pair are in each case connected at their plug connector-side ends, with inner conductor contact elements of the plug connector.

12. The plug connector arrangement of claim 1, wherein in the guide section of the plug connector the wires are in each case surrounded by a wire sleeve made of an electrically conductive material adjoining the expansion section in order to reduce the distance between the wires.

13. The plug connector arrangement of claim 12, wherein the end of each wire sleeve facing the expansion section surrounds the wire insulation and/or the other end of each wire sleeve surrounds and makes electrical contact with a non-insulated wire conductor, wherein preferably both ends of the wire sleeves are in each case crimped onto the wire.

14. The plug connector arrangement of claim 2, wherein the sleeve part is a clamping sleeve, a clip sleeve or C-sleeve.

15. The plug connector arrangement of claim 14, wherein the sleeve part has an inner surface which is angled, conical or convex, relative to the longitudinal direction of the cable (L), wherein preferably an inner diameter of the sleeve part is matched at its cable-side end to the first distance (X) and is matched at its plug connector-side end to the second distance (Y).

16. The plug connector arrangement of claim 15, including a spacer projecting into the expansion section which is arranged between the wires of the wire pair and against which the wires are pressed by the sleeve part.

17. The plug connector arrangement of claim 6, wherein the sleeve part and/or the spacer is a plastics material.

18. The plug connector of claim 7, wherein the outer conductor part is an outer conductor housing.

19. The plug connector arrangement of claim 8, wherein the outer conductor is in the form of a conductor braid.

20. The plug connector arrangement of claim 8, wherein the sleeve part, at least at its cable-side end, has approximately the same inner diameter as the outer conductor of the cable and continues a shielding of the wire pair in the direction of the plug connector.

21. The plug connector arrangement of claim 11, wherein the wires of the wire pair are in each case crimped at their plug connector-side ends, with inner conductor contact elements of the plug connector.

* * * * *